US005598854A

United States Patent [19]

Gillie

[11] Patent Number: 5,598,854

[45] Date of Patent: Feb. 4, 1997

[54] ASHTRAY CIGARETTE EXTINGUISHING DEVICE

[76] Inventor: Glenn F. Gillie, 5717 Hawthorne La., Portsmouth, Va. 23703

[21] Appl. No.: 396,470

[22] Filed: Mar. 2, 1995

[51] Int. Cl.[6] ..... A24F 19/14

[52] U.S. Cl. ..... 131/235.1; 131/256; 296/37.9

[58] Field of Search ..... 131/235.1, 256; 296/37.9

[56] References Cited

U.S. PATENT DOCUMENTS 2,555,716 6/1951 Todhunter ..... 131/235.1 X 2,908,281 10/1959 Jacobs et al. ..... 296/37.9 X

*Primary Examiner*—Jennifer Bahr

[57] ABSTRACT

An extinguishing device for snuffing out a burning cigarette. The inventive device includes an ashtray for receiving ashes from a cigarette. An extinguishing assembly projects into the ashtray for facilitating compression of the burning end of the cigarette to extinguish combustion therewithin.

4 Claims, 4 Drawing Sheets

ASHTRAY CIGARETTE EXTINGUISHING DEVICE

BACKGROUND OF THE INVENTION

1. Field of the Invention

The present invention relates to mechanical fire extinguishing structures and more particularly pertains to an ashtray cigarette extinguishing device for snuffing out a burning cigarette.

2. Description of the Prior Art

The use of mechanical fire extinguishing structures is known in the prior art. More specifically, mechanical fire extinguishing structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art mechanical fire extinguishing structures include U.S. Pat. Nos. 3,871,387; 4,660,575; 3,620,226; 4,984,586; 4,497,329; and 3,937,229.

While these devices fulfill their respective, particular objectives and requirements, the aforementioned patents do not disclose an ashtray cigarette extinguishing device for snuffing out a burning cigarette which includes an ashtray for receiving ashes from a cigarette, and an extinguishing assembly projecting into the ashtray for facilitating compression of the burning end of the cigarette to extinguish combustion therewithin.

In these respects, the ashtray cigarette extinguishing device according to the present invention substantially departs from the conventional concepts and designs of the prior art, and in so doing provides an apparatus primarily developed for the purpose of snuffing out a burning cigarette.

SUMMARY OF THE INVENTION

In view of the foregoing disadvantages inherent in the known types of mechanical fire extinguishing structures now present in the prior art, the present invention provides a new ashtray cigarette extinguishing device construction wherein the same can be utilized for extinguishing a cigarette. As such, the general purpose of the present invention, which will be described subsequently in greater detail, is to provide a new ashtray cigarette extinguishing device apparatus and method which has many of the advantages of the mechanical fire extinguishing structures mentioned heretofore and many novel features that result in a ashtray cigarette extinguishing device which is not anticipated, rendered obvious, suggested, or even implied by any of the prior art mechanical fire extinguishing structures, either alone or in any combination thereof.

To attain this, the present invention generally comprises an extinguishing device for snuffing out a burning cigarette. The inventive device includes an ashtray for receiving ashes from a cigarette. An extinguishing assembly projects into the ashtray for facilitating compression of the burning end of the cigarette to extinguish combustion therewithin.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ashtray cigarette extinguishing device apparatus and method which has many of the advantages of the mechanical fire extinguishing structures mentioned heretofore and many novel features that result in a ashtray cigarette extinguishing device which is not anticipated, rendered obvious, suggested, or even implied by any of the prior art mechanical fire extinguishing structures, either alone or in any combination thereof.

It is another object of the present invention to provide a new ashtray cigarette extinguishing device which may be easily and efficiently manufactured and marketed.

It is a further object of the present invention to provide a new ashtray cigarette extinguishing device which is of a durable and reliable construction.

An even further object of the present invention is to provide a new ashtray cigarette extinguishing device which is susceptible of a low cost of manufacture with regard to both materials and labor, and which accordingly is then susceptible of low prices of sale to the consuming public, thereby making such ashtray cigarette extinguishing devices economically available to the buying public.

Still yet another object of the present invention is to provide a new ashtray cigarette extinguishing device which provides in the apparatuses and methods of the prior art some of the advantages thereof, while simultaneously overcoming some of the disadvantages normally associated therewith.

Still another object of the present invention is to provide a new ashtray cigarette extinguishing device for snuffing out a burning cigarette.

Yet another object of the present invention is to provide a new ashtray cigarette extinguishing device which includes an ashtray for receiving ashes from a cigarette, and an extinguishing assembly projecting into the ashtray for facilitating compression of the burning end of the cigarette to extinguish combustion therewithin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
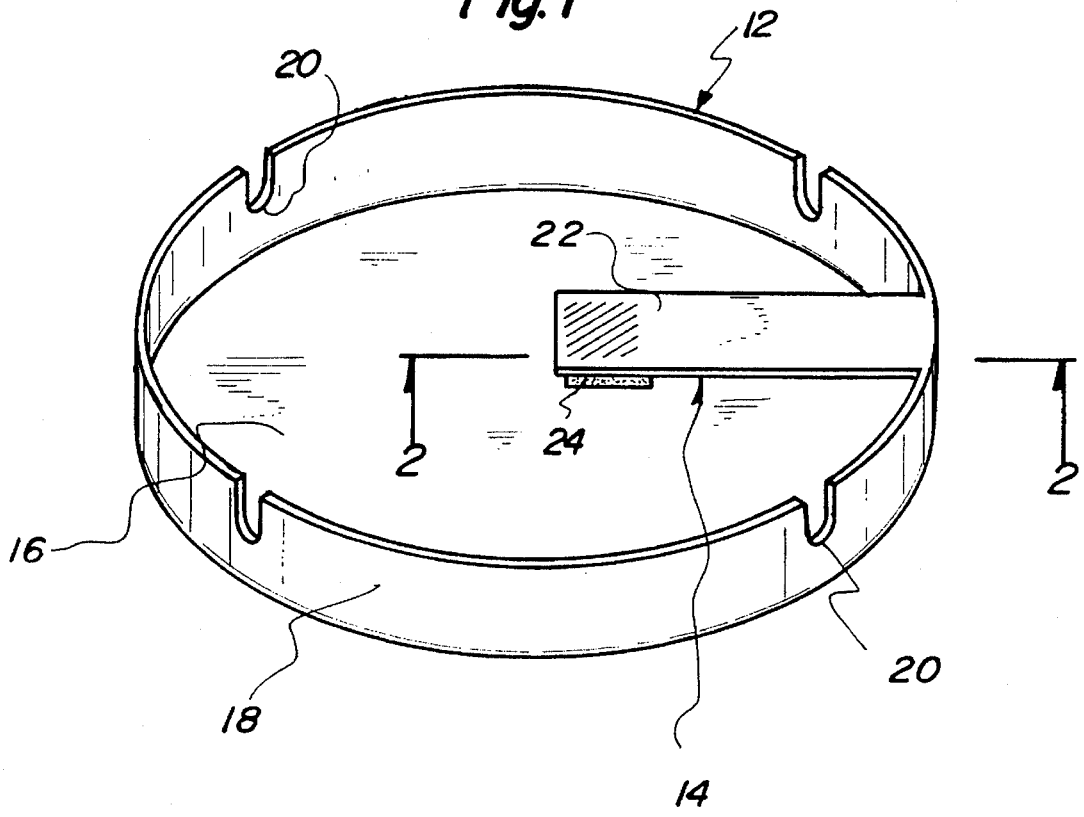
FIG. 1 is an isometric illustration of an ashtray cigarette extinguishing device according to the present invention.

With reference now to the drawings, and in particular to FIGS. 1–8 thereof, a new ashtray cigarette extinguishing device embodying the principles and concepts of the present invention and generally designated by the reference numeral 10 will be described.

More specifically, it will be noted that the ashtray cigarette extinguishing device 10 comprises an ashtray means 12 for receiving ashes from a burning cigarette or other combustible item. An extinguishing means 14 is coupled to the ashtray means 12 and projects into an interior of the ashtray means for mechanically compressing a burning end of a cigarette to extinguish combustion therewithin. By this structure, an individual desiring to extinguish a cigarette can utilize the extinguishing means 14 to facilitate mechanical compression and snuffing out of such cigarette.

Figure 2:
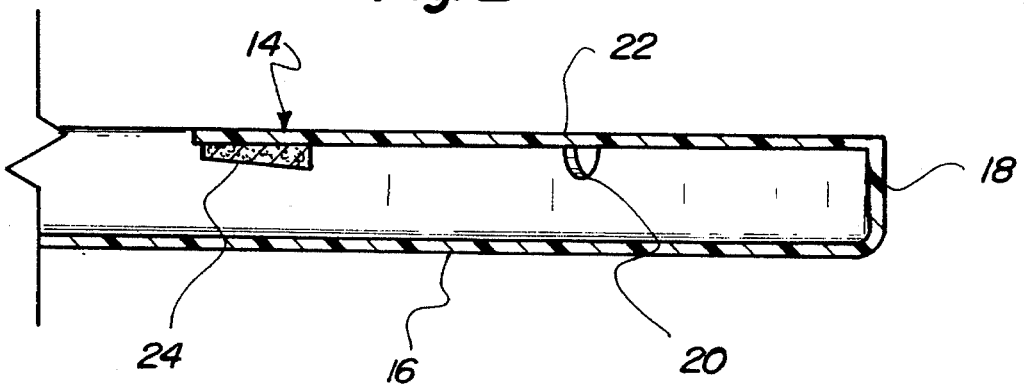
FIG. 2 is a cross sectional view taken along line 2—2 of FIG. 1.
Figure 3:
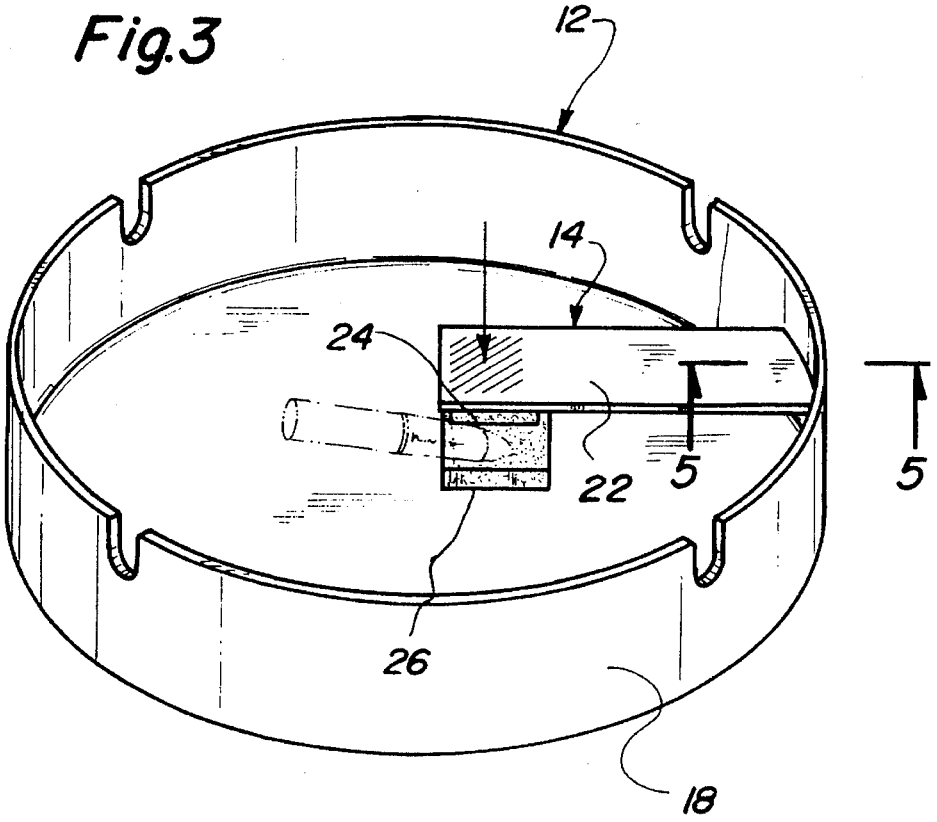
FIG. 3 is an isometric illustration of an alternative form of the present invention.
Figure 4:
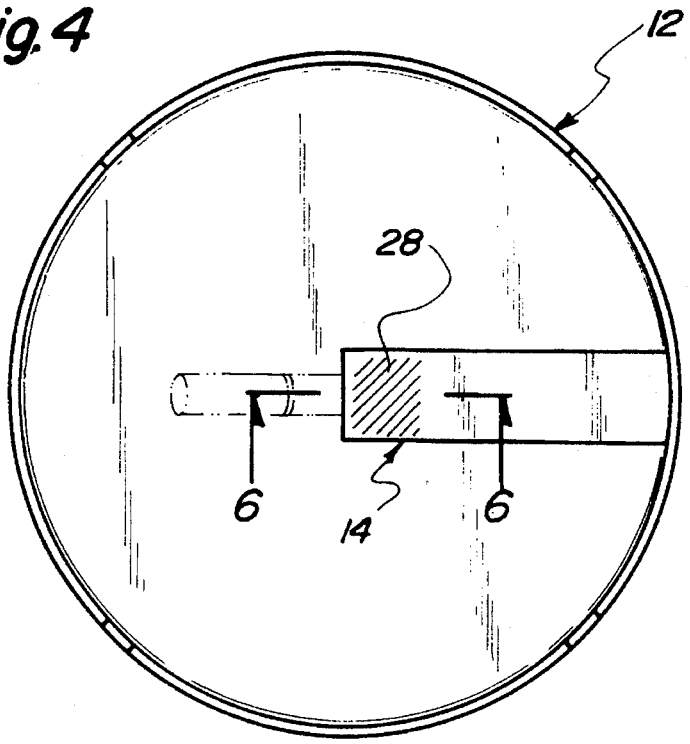
FIG. 4 is a top plan view of the alternative form of the invention.

As best illustrated in FIGS. 1 and 2, it can be shown that the ashtray means 12 according to the present invention 10 includes a base wall 16 of substantially planar configuration, with a perimeter side wail 18 projecting upwardly from an outer periphery of the base wall. A plurality of notches 20 are directed into the perimeter side wall 18 and permit the insertion and engagement of a cigarette so as to support the cigarette relative to the ashtray means 12. By this structure, ashes from a cigarette or other smoking device can be deposited within the confines of the perimeter side wall 18 for storage and/or transportation purposes.

With continuing reference to FIGS. 1 end 2, it can be shown that the extinguishing means 14 according to the present invention 10 preferably comprises a lever arm 22 coupled to and projecting from the perimeter side wall 18 of the ashtray means 12. The lever arm 22 projects radially inward from the perimeter side wall and terminates in a free distal end. The lever arm 22 is constructed of a substantially resilient material whereby an individual can manually bias the free distal end of the lever arm towards the base wall 16. As shown in FIG. 2, a lever arm snuffing pad 24 is mounted to a lower surface of the lever arm 22 and positioned for engagement against the base wall 16 when the lever arm 22 is deflected by a digit of a human hand or the like. To insure abutting engagement of the snuffing pad 24 to the base wall 16, the lever arm snuffing pad 24 is shaped so as to define an angled engaging surface. In other words, the lever arm snuffing pad 24 is of a first thickness proximal to the free distal end of the lever arm 22 and tapers to a second thickness removed from the free distal end of the lever arm, wherein the second thickness is substantially greater than the first thickness so as to define the angled lower wall of the lever arm snuffing pad 24. By this structure, an individual desiring to extinguish a cigarette can position a burning end of such cigarette beneath the lever arm snuffing pad 24, whereby a manual depression of the lever arm 22 will effect mechanical compression of the burning end of the cigarette to extinguish combustion therewithin.

Figure 5:
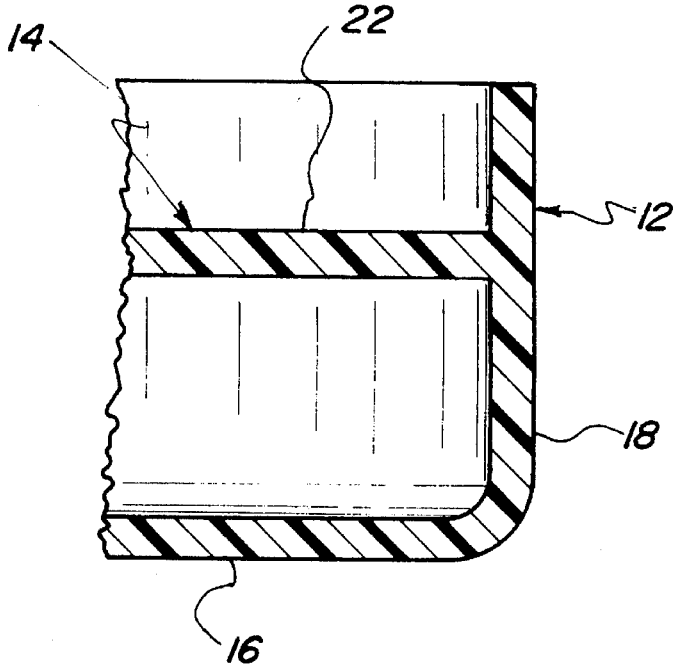
FIG. 5 is a cross sectional view taken along line 5—5 of FIG. 3.
Figure 6:
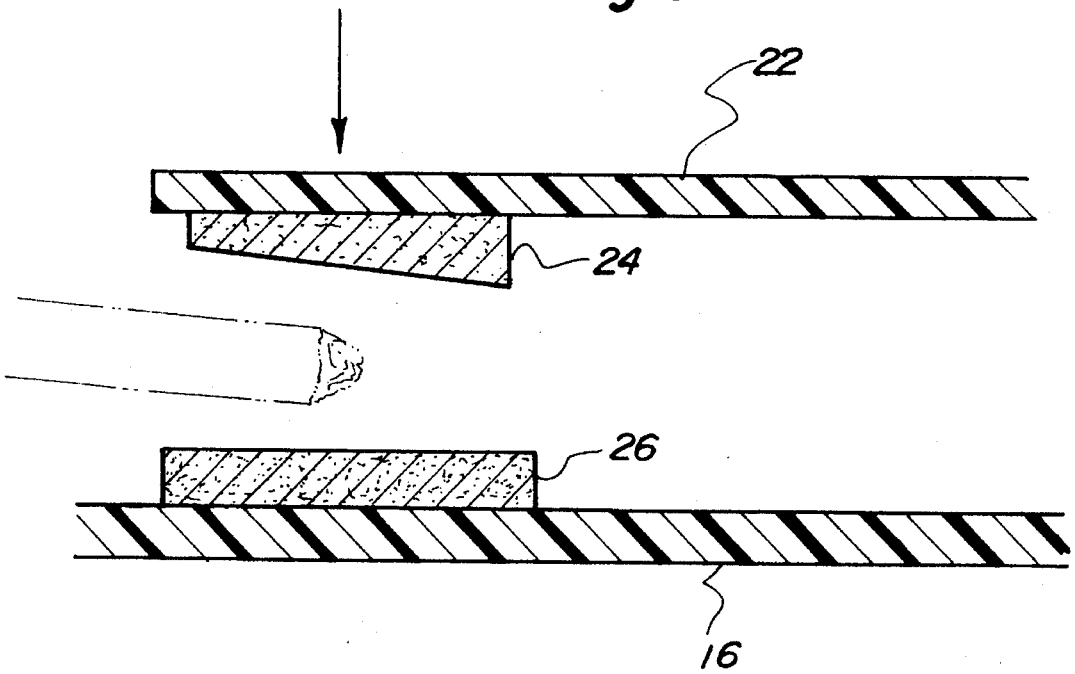
FIG. 6 is a cross sectional view taken along line 6—6 of FIG. 4.

Referring now to FIGS. 3 through 6 wherein an alternative form the present invention is illustrated, it can be shown that the lever arm 22 can be mounted to an interior surface of the perimeter side wall 18 and, as shown in FIG. 5, the lever arm 22 may integrally formed with the perimeter side wall. Further, the alternative form of the present invention 10 may additionally comprise a base wall snuffing pad 26 positioned beneath the lever arm snuffing pad 24 and cooperatively aligned therewith as shown in FIG. 6 of the drawings. To preclude slipping of an individual's finger relative to the lever arm 22, and upper surface of the lever arm may be shaped so as to define a textured gripping surface 28 for enhancing frictional engagement between the individual's finger and the upper surface of the lever arm 22.

Figure 7:
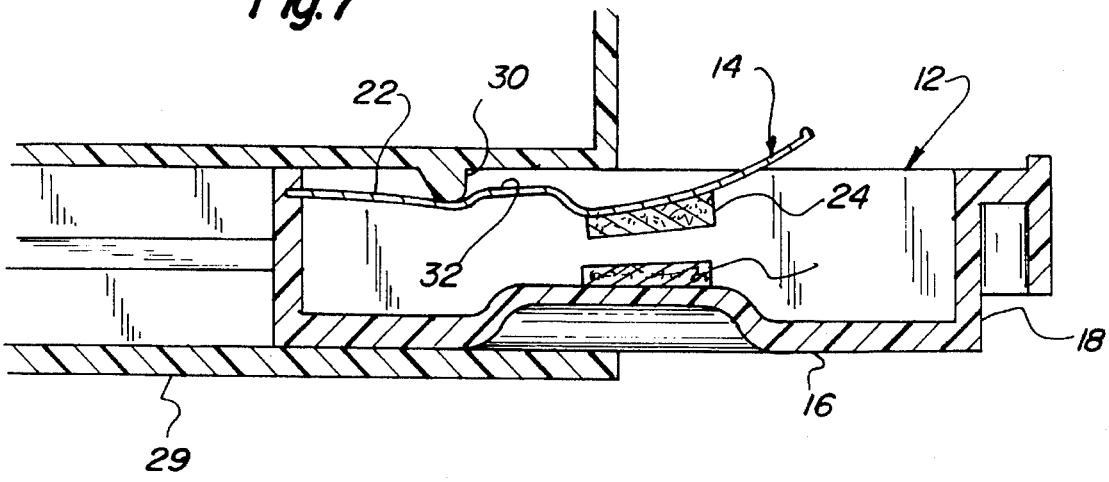
FIG. 7 is a cross sectional view of an alternative form of the present invention incorporated into an automobile ashtray.
Figure 8:
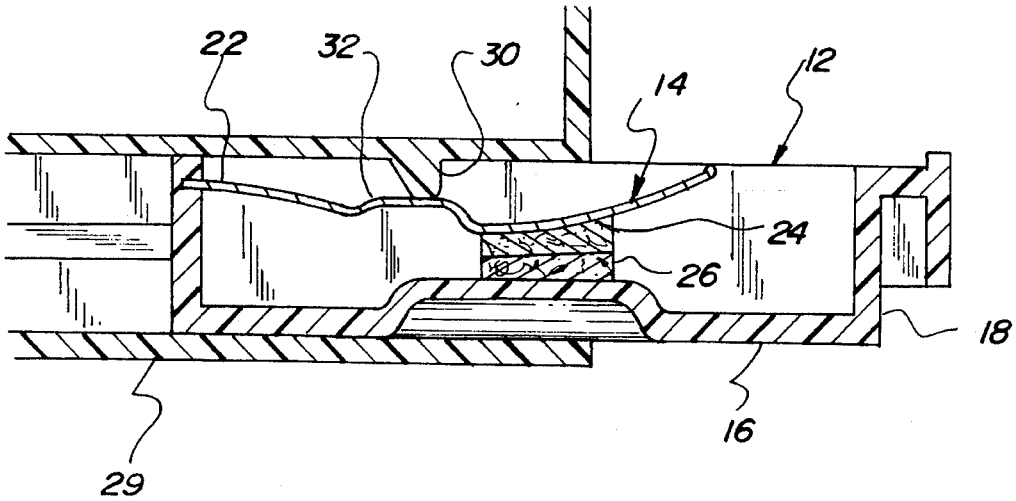
FIG. 8 is a further cross sectional view of the alternative form of the invention.

As shown in FIGS. 7 and 8, the present invention 10 may be incorporated into a vehicle or automobile ashtray wherein the ashtray means 12 is slidably received within an ashtray receiver 29 mountable within a dashboard or the like. A depending projection 30 extends downwardly from an interior of the ashtray receiver and is positioned for engagement with the lever arm 22. In this alternative form of the invention 10, the lever arm 22 is shaped so as to define a raised portion 32 which engages the depending projection 30 during closing or positioning of the ashtray means 12 into the ashtray receiver 29 so as to force the lever arm 22 towards the base wall 16 of the ashtray means. Such movement of the lever arm 22 will result in a cooperative engagement of the lever arm snuffing pad 24 against the base wall snuffing pad 26 to effect mechanical extinguishing of a cigarette positioned therebetween.

In use, the ashtray cigarette extinguishing device 10 according to the present invention can be easily utilized to snuff out a burning cigarette. The present invention 10 substantially eliminates a need for utilizing a substantially ineffective prior art method wherein the cigarette is axially advanced into contact with an object to extinguish a burning end of a cigarette.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An ashtray cigarette extinguishing device comprising:

an ashtray means for receiving ashes from a burning cigarette;

an extinguishing means coupled to the ashtray means and projecting into an interior of the ashtray means for mechanically compressing a burning end of a cigarette to extinguish combustion therewithin;

wherein the ashtray means includes a base wall; and a perimeter side wall projecting upwardly from an outer periphery of the base wall;

wherein the extinguishing means comprises a lever arm coupled to and projecting from the perimeter side wall of the ashtray means, the lever arm terminating in a free distal end and being constructed of a substantially resilient material whereby an individual can manually bias the free distal end of the lever arm towards the base wall of the ashtray means; and a lever arm snuffing pad mounted to a lower surface of the lever arm and positioned for engagement against the base wall when the lever arm is deflected towards the base wall; and wherein the lever arm snuffing pad is shaped to as to define an angled engaging surface positioned for engagement against the base wall such that the lever arm snuffing pad is of a first thickness at a first end thereof and tapers to a second thickness at a second end thereof.

2. The ashtray cigarette extinguishing device of claim 1, and further comprising a base wall snuffing pad coupled to the base wall and positioned beneath the lever arm snuffing pad and cooperatively aligned therewith.

3. The ashtray cigarette extinguishing device of claim 2, and further comprising an ashtray receiver, with the ashtray means being slidably received within the ashtray receiver.

4. The ashtray cigarette extinguishing device of claim 3, wherein the ashtray receiver includes a depending projection extending downwardly from an interior of the ashtray receiver and positioned for engagement with the lever arm of the extinguishing means, the lever arm being shaped so as to define a raised portion which engages the depending projection during positioning of the ashtray means into the ashtray receiver so as to force the lever arm towards the base wall of the ashtray means during positioning of the ashtray means into the receiver.

* * * * *